US007890041B2

(12) United States Patent
Kobayashi

(10) Patent No.: US 7,890,041 B2
(45) Date of Patent: Feb. 15, 2011

(54) FIXING DEVICE AND IMAGE FORMING APPARATUS

(75) Inventor: Kei Kobayashi, Tokyo (JP)

(73) Assignee: Oki Data Corporation, Tokyo (JP)

( * ) Notice: Subject to any disclaimer, the term of this patent is extended or adjusted under 35 U.S.C. 154(b) by 52 days.

(21) Appl. No.: 12/232,892

(22) Filed: Sep. 25, 2008

(65) Prior Publication Data

US 2009/0136273 A1 May 28, 2009

(30) Foreign Application Priority Data

Nov. 26, 2007 (JP) ..... 2007-304448

(51) Int. Cl.
*G03G 15/20* (2006.01)

(52) U.S. Cl. ..... 399/329; 219/216

(58) Field of Classification Search ..... 399/329, 399/328, 320; 219/216; 347/156
See application file for complete search history.

(56) References Cited

U.S. PATENT DOCUMENTS 6,459,877 B1 * 10/2002 Yoda et al. ..... 219/216 X
2007/0280757 A1 * 12/2007 Kimura ..... 399/329
2007/0292175 A1 * 12/2007 Shinshi ..... 399/329
2008/0056783 A1 * 3/2008 Yamamoto et al. ..... 399/329
2008/0219724 A1 * 9/2008 Lee et al. ..... 399/329

FOREIGN PATENT DOCUMENTS

JP 2002-333788 11/2002
JP 2003-280417 10/2003
JP 2004-133444 4/2004
JP 2005-300986 A * 10/2005
JP 2007-156276 6/2007
JP 2007-322888 12/2007

* cited by examiner

*Primary Examiner*—Sophia S Chen
(74) *Attorney, Agent, or Firm*—Rabin & Berdo, PC

(57) ABSTRACT

A fixing device and an image forming apparatus including the fixing device are supplied capable of preventing life of roller from shortening due to big shearing warp. In the fixing device to fix a toner image that is transferred on a record medium though using an endless belt heated by a heating member, the endless belt is extended by a first pressing member and the heating member; a second pressing member and the first pressing member sandwich and hold the endless belt to press the endless belt; and a rotating member is externally contacted with the endless belt and drives the endless belt to move.

10 Claims, 6 Drawing Sheets

FIXING DEVICE AND IMAGE FORMING APPARATUS

BACKGROUND OF THE INVENTION

The invention relates to a fixing device used in a copying apparatus, a printer, a facsimile apparatus or the like, and relates to an image forming apparatus using the fixing device.

FIELD OF THE INVENTION

In recent years, as a purpose to save electric power or to shorten rising time, an image forming apparatus having a fixing device that uses an endless belt, is utilized (refer to patent document 1). Here, regarding the fixing device that uses the endless belt, its summary will be explained.

FIG. 7 is an explanatory diagram of a fixing device that uses a conventional endless belt.

As shown by FIG. 7, "2" is a pressing roller. The pressing roller 2 has a metal shaft 2*a* and an elastic layer 2*b*, and is a roller for receiving a rotation drive force from a drive source (not shown) via the metal shaft 2*a*. "3" is a fixing roller. The fixing roller 3 has a metal shaft 3*a* and an elastic layer 3*b*, and is a roller that is pressed by the pressing roller 2 to form a nip part N. A fixation belt 4 is an endless belt, as shown by FIG. 7, is a cylinder-shaped belt which is extended by the fixing roller and a supporting body 5. "6" is a heat source. The heat source 6 is a surface shape and is contacted with an inner surface of the fixation belt 4.

In the fixing device that uses the conventional endless belt and has the above-mentioned structure, the pressing roller 2 is driven to rotate by the drive source (not shown). When the pressing roller 2 is driven to rotate, the fixing roller 3 is driven to rotate through a friction force between the pressing roller 2 and the fixation belt 4 and through a friction force between the fixation belt 4 and the fixing roller 3. When the fixing roller 3 is driven to rotate, the fixation belt 4 is driven to move while resisting to a friction force between the fixation belt 4 and the supporting body 5. The fixation belt 4 is maintained at a predetermined temperature by the heat source 6. A record sheet (not shown) is conveyed by the fixation belt 4 which is maintained at the predetermined temperature by the heat source 6, and passes the nip part N. As a result, toner is heated and is pressed so as to be fixed on the record sheet. Here, because the pressing roller 2 presses the fixing roller 3 to form the nip part N, so it is possible to supply the record sheet and toner with sufficient heat amount.

Patent document 1: Japan patent application No. 2006-154823.

As stated above, in the fixing device that uses the conventional endless belt, it is necessary to increase the rotation drive force and the pressure of the pressing roller 2 in order to make the fixation belt 4 drive to move while resisting to the friction force between the fixation belt 4 and the supporting body 5. As a result, in the elastic layer 2*b* of the pressing roller 2 and in the elastic layer 3*b* of the fixing roller 3 (especially, in the elastic layer 2*b* of the pressing roller 2), a shearing warp in a rotation direction becomes big, thus, life is shortened.

SUMMARY OF THE INVENTION

It is, therefore, an object of the invention to provide a fixing device and an image forming apparatus capable of solving the above problem.

An aspect of the invention is to provide a fixing device. The fixing device to fix a toner image that is transferred on a record medium though using an endless belt heated by a heating member, comprises a first pressing member; a second pressing member; and a rotating member, wherein the endless belt is extended by the first pressing member and the heating member; the second pressing member and the first pressing member sandwich and hold the endless belt to press the endless belt; and the rotating member is externally contacted with the endless belt and drives the endless belt to move.

Another aspect of the invention is to provide an image forming apparatus. The image forming apparatus comprises a fixing device to fix a toner image that is transferred on a record medium though using an endless belt heated by a heating member, includes: wherein the fixing device includes: a first pressing member; a second pressing member; and a rotating member, wherein the endless belt is extended by the first pressing member and the heating member; the second pressing member and the first pressing member sandwich and hold the endless belt to press the endless belt; the rotating member is externally contacted with the endless belt and drives the endless belt to move.

EFFECT OF THE PRESENT INVENTION

Through having the rotating member that is externally contacted with the endless belt and drives to move the endless belt, the rotating member shares a driving force for making the endless belt drive to move, therefore, shearing warp in a rotation direction, that occurs inside of the first pressing member and the second pressing member is greatly reduced. As a result, it is possible to prevent a life shortening of both members.

The above and other objects and features of the present invention will become apparent from the following detailed description and the appended claims with reference to the accompanying drawings.

DETAILED DESCRIPTION OF THE PREFERRED EMBODIMENTS

Figure 1:
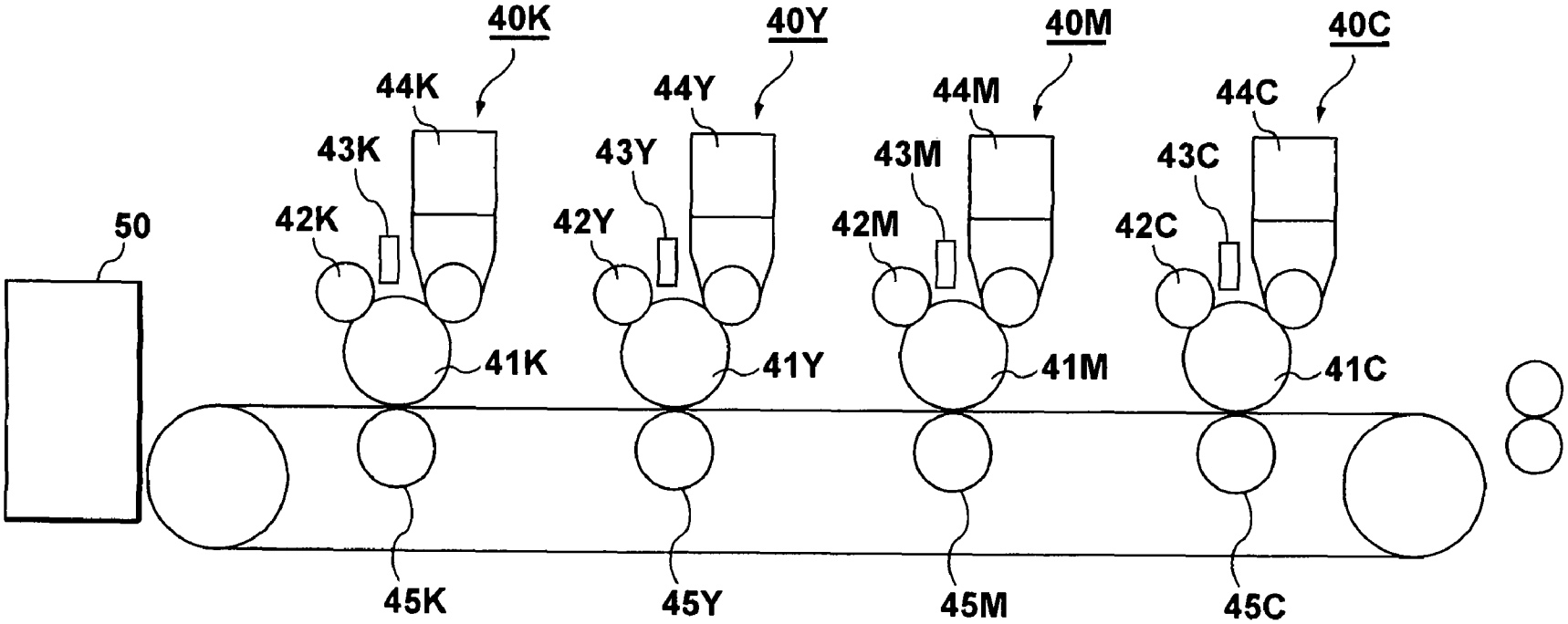
FIG. 1 is an explanatory diagram of an image forming apparatus of the present invention.

FIG. 1 is an explanatory diagram of an image forming apparatus of the present invention.

As the image forming apparatus of the present invention, it will be explained through using a color printer serving as an example. As shown by FIG. 1, 40K, 40Y, 40M and 40C are developing apparatuses that develop through using respective colors of black, yellow, magenta and cyan. "50" is a fixing device. A structure of the developing apparatus of each color is the same, therefore, only the black developing apparatus 40K will be explained as an example. In FIG. 1: 41Y, 41M and 41C correspond to 41K for the colors of yellow, magenta and cyan respectively; 42Y, 42M and 42C correspond to 42K for the colors of yellow, magenta and cyan respectively; 43Y, 43M and 43C correspond to 43K for the colors of yellow, magenta and cyan respectively; 44Y, 44M and 44C correspond to 44K for the colors of yellow, magenta and cyan respectively; and 45Y, 45M and 45C correspond to 45K for the colors of yellow, magenta and cyan respectively.

The black developing apparatus 40K has a image carrying body 41K, a charging section 42K, a latent image forming section 43K, a developing section 44K and a transferring section 45K. The image carrying body 41K is a photosensitive drum. The charging section 42K charges a surface of the image carrying body 41K negatively. The latent image forming section 43K irradiates with light the surface of the image carrying body 41K that is charged negatively, and forms an electrostatic latent image. The developing section 44K supplies the electrostatic latent image with toner, and develops the electrostatic latent image. The developed toner image is transferred on a record medium by the transferring section 45K. Further, the toner image that is transferred on the record medium, is transferred on the record medium by the fixing device 50 and is ejected. Embodiment explained below is about the fixing device 50. The following is to explain embodiment of the present invention in detail through using drawings.

Embodiment 1

Figure 2:
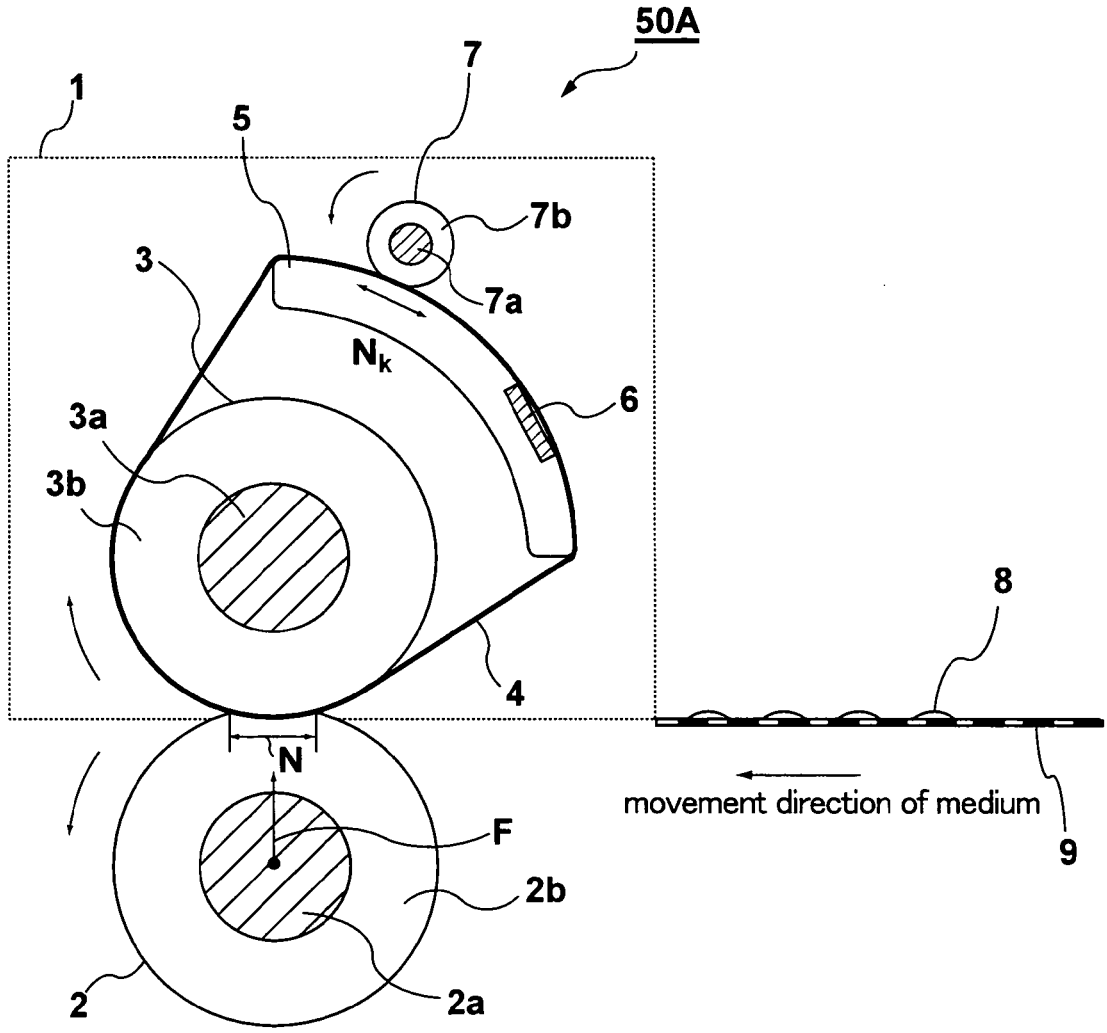
FIG. 2 is an explanatory diagram of a fixing device in embodiment 1.

FIG. 2 is an explanatory diagram of a fixing device in embodiment 1.

As shown by FIG. 2, the fixing device 50A of embodiment 1 comprises a pressing roller 2, a fixing roller 3, a fixation belt 4, a supporting body 5, a heat source 6 and a drive use assisting roller 7.

The pressing roller 2 has a metal shaft 2*a* and an elastic layer 2*b*. Further, the pressing roller 2 is a roller whose diameter is 20 mm~40 mm, and which forms a nip part N through providing a pressure F to the fixing roller 3 which is opposite to the pressing roller 2. Here, the metal shaft 2*a* is a shaft formed from iron material or the like, and is axis-supported rotation-freely by a shaft holding portion (not shown). And, the elastic layer 2*b* is formed concentrically on a circumference surface of the metal shaft 2*a*; and is a heat-resistant elastic member whose thickness is 1 mm~10 mm formed from, for example, a silicon rubber or the like. Further, on the surface, fluorine series resin is accumulated 10 μm~50 μm as a mold release layer.

The fixing roller 3 has a metal shaft 3*a* and an elastic layer 3*b*. Further, the fixing roller 3 is a roller whose diameter is 20 mm~40 mm, and which forms the nip part N through being provided a pressure F by pressing roller 2. As well as the press roller 2, the metal shaft 3*a* is a shaft formed from iron material or the like, and is axis-supported rotation-freely by the shaft holding portion (not shown). And, the elastic layer 3*b* is formed concentrically on a circumference surface of the metal shaft 3*a*; and is a heat-resistant elastic member whose thickness is 1mm~10 mm formed from, for example, a silicon rubber or the like. Further, on the surface, fluorine series resin is accumulated 10 μm~50 μm as a mold release layer.

The fixation belt 4, as shown by FIG. 2, is an endless belt that is extended by the fixing roller 3 and the supporting body 5. Here, regarding the fixation belt 4, it will be explained in detail through using other diagram.

Figure 3:
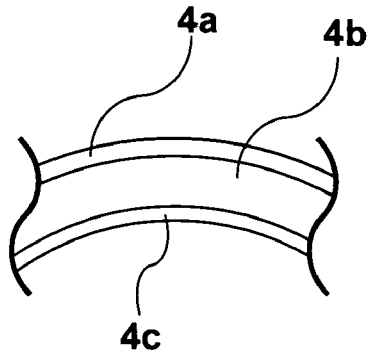
FIG. 3 is an explanatory diagram of an endless belt.

FIG. 3 is an explanatory diagram of an endless belt.

As shown by FIG. 3, the endless belt (the fixation belt 4) is formed by accumulating thin silicon rubber or fluorine series resin to serve as an elastic layer 4*b* on a circumference surface of a base member 4*c* formed from a thin board of nickel, polyimide, stainless or the like. Further, as a mold release layer 4*b*, PFA (perfluoro alkoxyl alkane), PTFE (polytetrafluoroethylene), FEP (fluorinated ethylene propylene copolymer) or the like is accumulated thin on the surface of the elastic layer 4*b*. These materials are excellent in heat-resistant. From the point of strength or heat-resistant, the size of the base member 4*c* is desirable 30 μm~150 μm; the thickness of the elastic layer 4*b* is desirable about 50 μm~300 μm; and the thickness of the mold release layer 4*b* is desirable 10 μm~50 μm.

As shown by FIG. 2, the supporting body 5 is a part that extends the fixation belt 4 with the fixing roller 3. The part is formed from resin having high heat-resistant such as PPS (polyphenylene sulfide), PEEK (polyetheretherketone), LCP (Liquid Crystal Polymer) or the like. In consideration of a transform or a breakage due to heat, the part can also be formed by adopting material such as glass fiber, glass beads or the like for strengthening. Moreover, it is possible to provide fluorine grease to between the fixation belt 4 and the supporting body 5 in order to reduce friction.

The heat source 6 is contacted with the inner surface of the fixation belt 4, and is a surface-shaped heat source that heats the fixation belt 4. The heat source 6, as shown by FIG. 2, is furnished on upstream side from the nip part N with respect to a movement direction of the fixation belt 4. Further, the heat source 6 is also furnished on upstream side from the nip part N with respect to a movement direction of the medium. Here, regarding a structure of the heat source 6, it will be explained in detail through using other drawing.

Figure 4:
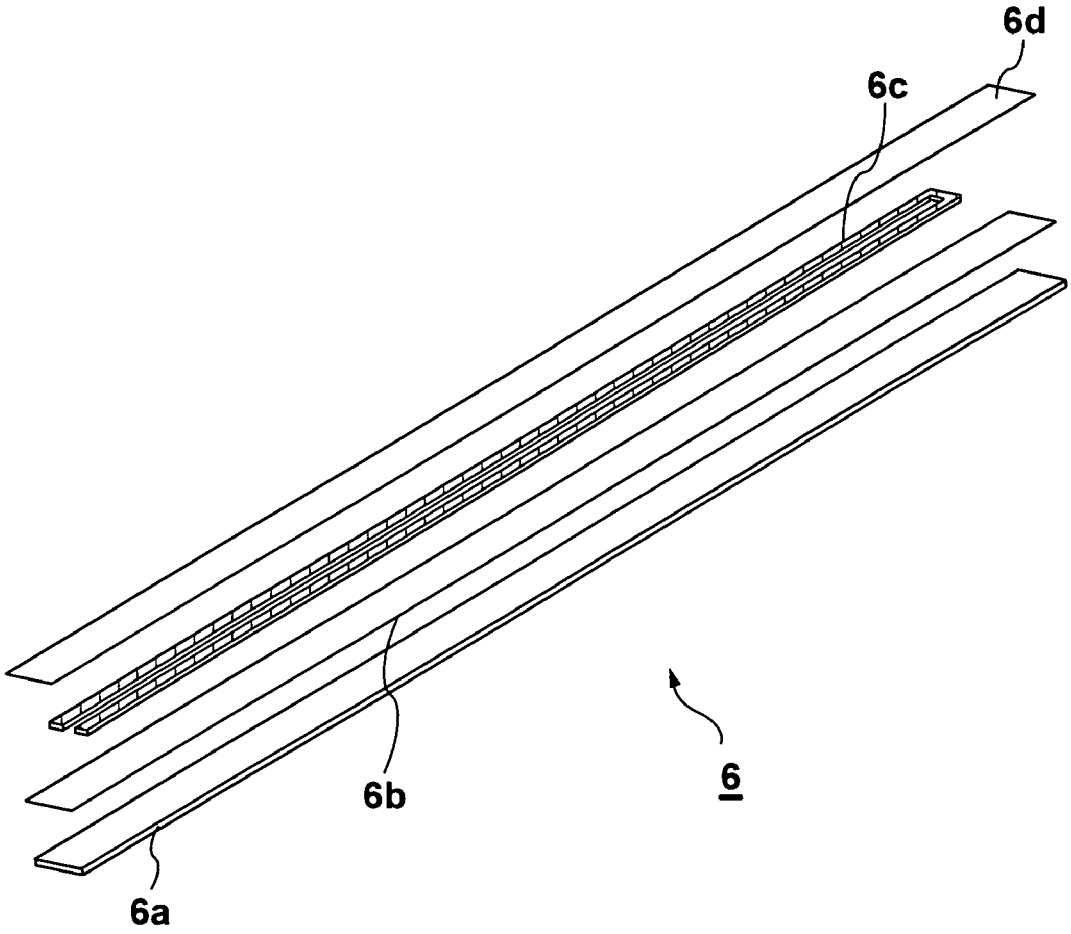
FIG. 4 is an explanatory diagram of a heat source.

FIG. 4 is an explanatory diagram of a heat source.

As shown by FIG. 4, the heat source 6 is formed to include an electricity insulating layer 6*b* that is formed from glass material on a base member 6*a* that is formed from a board of stainless or ceramic; a resistance heating element 6*c* that is formed from nickel chromium alloy, silver palladium alloy or the like on the electricity insulating layer 6*b*; and a protection layer 6*d* that is formed from glass, fluorine series resin (PFA, PTFE, FEP). Moreover, an outer surface of the heat source 6 is desirable to be formed by a same curvature as that of the fixation belt 4 in the state that the fixation belt 4 is extended by the fixing roller 3 and the supporting body 5.

The heat source 6 stated above is an example. Here, regarding other example of a heat source, it will be explained.

Figure 5:
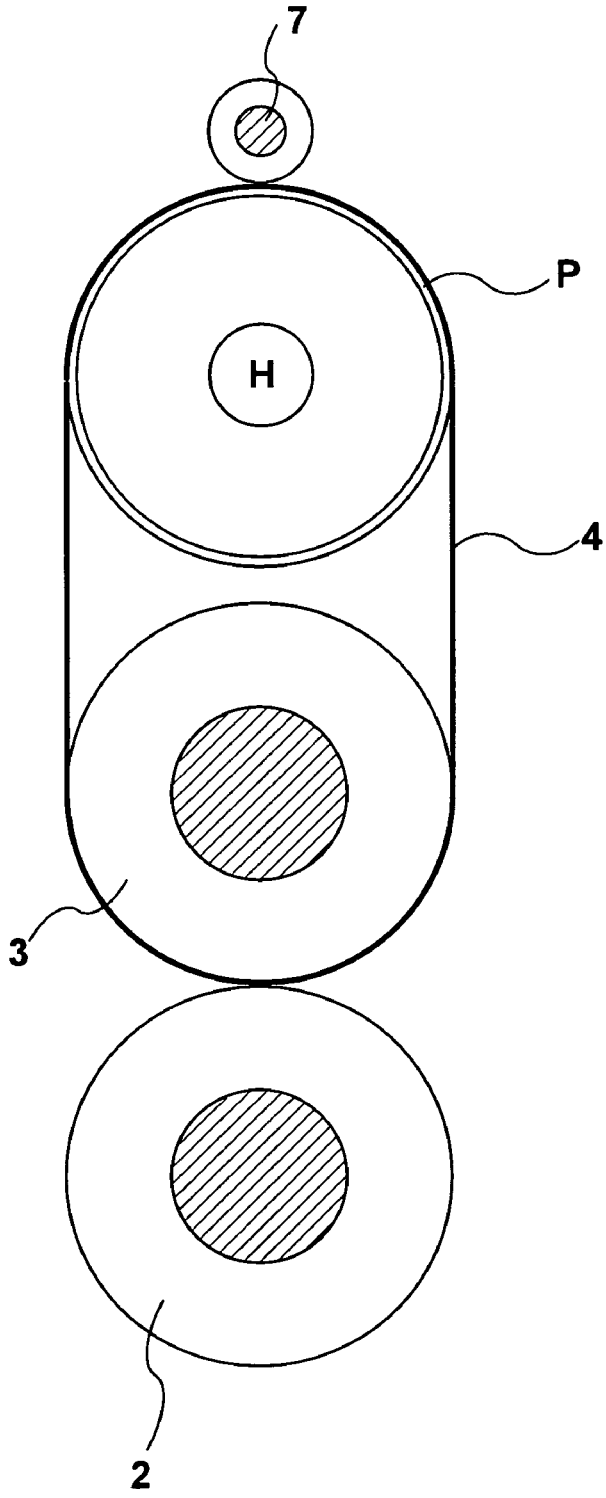
FIG. 5 is an explanatory diagram of a heat source of other example.

FIG. 5 is an explanatory diagram of a heat source of other example.

As shown by FIG. 5, it is possible to furnish a halogen heater H serving as a heat source inside a metallic pipe P, to heat the fixation belt 4 via the metallic pipe P.

As shown by FIG. 2, the drive use assisting roller 7 has a metal shaft 7*a* and an elastic layer 7*b*. Further, the drive use assisting roller 7 is a roller that sandwiches and holds the fixation belt 4 with the supporting body 5; presses the fixation belt 4 from the outer surface to generate a nip part Nk; receives rotation drive force from the drive source (not shown); and make the fixation belt 4 drive to move. Here, when the fixation belt 4 is driven to move while resisting to a friction force between the fixation belt 4 and the supporting body 5, the drive force is conducted to the fixing roller 3 via friction force between the fixation belt 4 and the fixing roller 3, thus, the fixing roller 3 is driven to rotate. Further, the friction force makes the pressing roller 2 be drive to rotate via friction force between the pressing roller 2 and the fixation belt 4.

The drive use assisting roller 7 contacts with the fixation belt 4 on upstream side from a position that the fixation belt 4 contacts with the surface-shaped heater and is heated, along a movement direction of the fixation belt 4. Therefore, it is possible to prevent an influence on the temperature of the fixation belt 4 heated by the surface-shaped heater.

The drive use assisting roller 7 is formed by accumulating a heat-resistant elastic layer 7*b* whose thickness is 0.5 mm~2 mm on the circumference surface of the metal shaft 7*a*. The heat-resistant elastic layer 7*b* is formed from a silicon rubber or the like, and the metal shaft 7*a* is formed from iron material or the like.

Moreover, it is possible to use other metal such as aluminum and the like instead of the iron material stated above as the metal shaft 2*a* of the pressing roller 2, the metal shaft 3*a* of the fixing roller 3 and the metal shaft 7*a* of the drive use assisting roller 7. Further, it is possible to use other elastic material such as silicon sponge, fluorine rubber and the like instead of the silicon rubber stated above. Moreover, the fixing roller 3, the fixation belt 4, the supporting body 5, the heat source 6 and the drive use assisting roller 7 are generally unified as a fixation belt assembly 1.

A fixing device 50A of embodiment 1 explained above operates as follows.

As shown by FIG. 2, when the drive use assisting roller 7 receives rotation drive force from the drive source (not shown), the fixation belt 4 receives the drive force via the nip part Nk; and moves while sliding with respect to the supporting body 5 and the heat source 6.

When electric power is supplied to the heat source 6, the heat source 6 generates heat, and the fixation belt 4 is heated via a sliding surface with the fixation belt 4. A surface temperature of the fixation belt 4 is detected by a temperature detecting means (not shown), and according to the detected temperature, the supplying electricity to the heat source 6 is controlled by a control of a controlling system. As a result, the surface temperature of the fixation belt 4 is maintained at a proper temperature.

The pressing roller 2 sandwiched and holds the fixation belt 4 with the fixing roller 3 which is furnished opposite to the pressing roller 2, further, provides the pressure F with respect to the fixing roller 3. By the pressure F, the friction force between the pressing roller 2 and the fixation belt 4, and the friction force between the fixation belt 4 and the fixing roller 3 are obtained. At the same time, the nip part N is formed.

As a result, a record medium 9 on which non-fixation toner 8 is transferred is conveyed to pass through the nip part N between the fixation belt 4 and the pressing roller 2. At that time, the non-fixation toner 8 on the record medium 9 is fixed through heat of the fixation belt 4 and through pressure of the pressing roller 2. Here, it becomes obvious experimentally that the fixation belt 4 is desirable to be extended by the fixing roller 3 and the supporting body 5 through a force of about 0.5 kg~2 kg.

According to the above explanation, in embodiment 1, by providing the drive use assisting roller 7, the drive force for making the fixation belt 4 be driven to move while resisting to the friction force between the fixation belt 4 and the supporting body 5, is shared with the drive use assisting roller 7, therefore, it is unnecessary to increase the pressure F of the pressing roller 2. Further, the pressing roller 2 drives to rotate, therefore, it is unnecessary to supply with drive force for making the fixation belt 4 be driven to move while resisting to the friction force between the fixation belt 4 and the supporting body 5. Accordingly, the shearing warp that occurs in the elastic layer 2*b* (and the elastic layer 3*b*) in rotation direction is greatly reduced. As a result, it is possible to prevent a shortening of life of both rollers.

Moreover, in the above explanation, only such case is explained that the fixation belt 4 is driven to rotate only by the drive use assisting roller 7, however, the present invention is not limited by the example. That is, through making one of the fixing roller 3 and the pressing roller 2 or both of them rotate in a rotation number that almost synchronize with a movement speed of the fixation belt 4, it is also possible to make the fixation belt 4 and the record medium 9 move more stably. In the case, the pressing roller 2 does not need to supply with excessive drive force for making the fixation belt 4 be driven to move while resisting to the friction force between the fixation belt 4 and the supporting body 5, so it is possible to obtain the same effect as above.

Embodiment 2

Figure 6A:
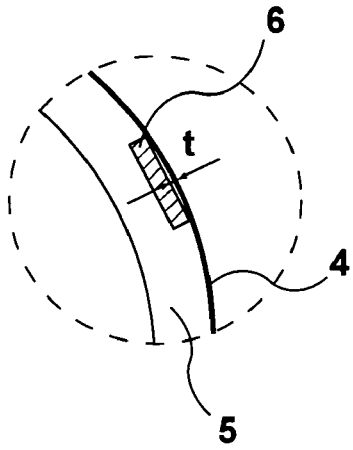
FIG. 6A is a part explanatory diagram for showing a contact state of the fixation belt 4 and the heat source 6 in embodiment 1.
Figure 6B:
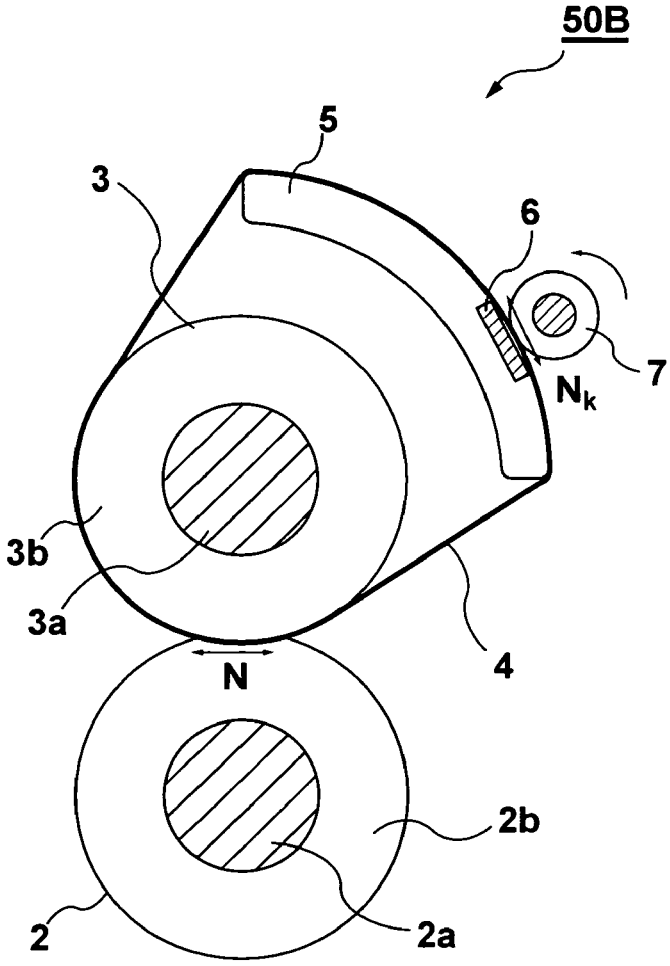
FIG. 6B is an explanatory diagram for showing a structure of a fixing device in embodiment 2.
Figure 7:
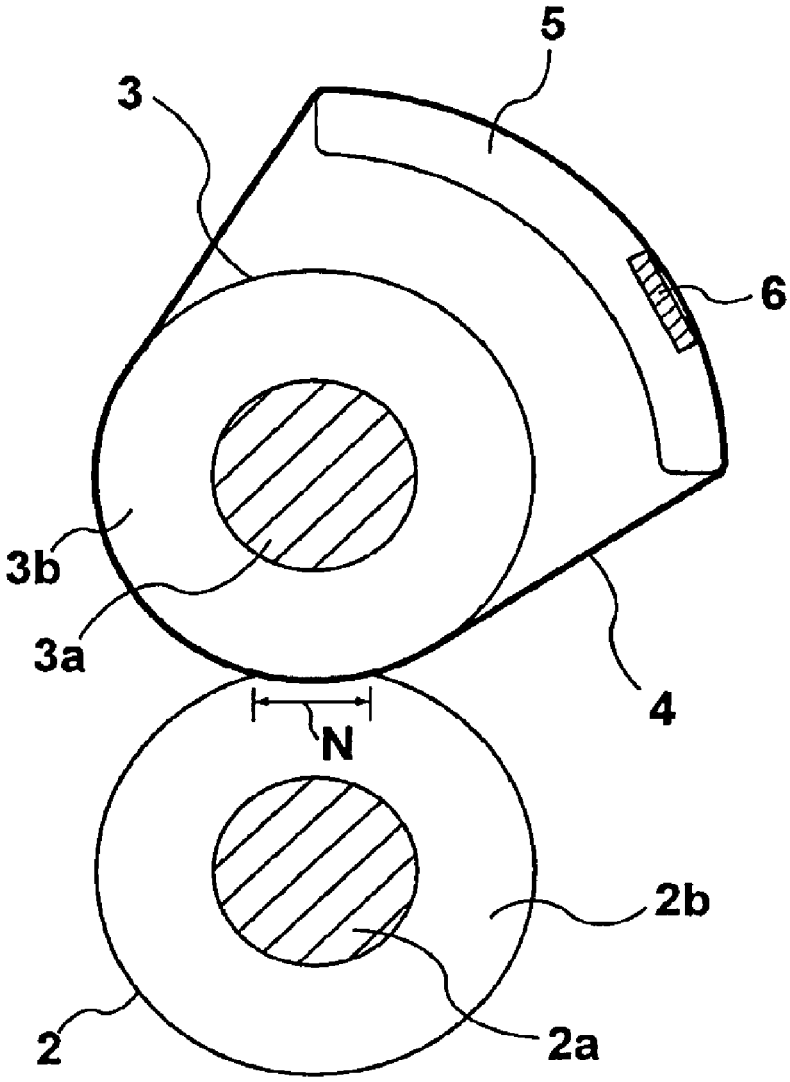
FIG. 7 PRIOR ART
FIG. 7 is an explanatory diagram of a fixing device that uses a conventional endless belt.

FIG. 6A is a part explanatory diagram for showing a contact state of the fixation belt 4 and the heat source 6 in embodiment 1; FIG. 6B is an explanatory diagram for showing a structure of a fixing device in embodiment 2.

As explained by using FIG. 3 in embodiment 1, the fixation belt 4 moves along an arc surface of the supporting body 5. And the heat source 6 is furnished in concave place on the arc surface of the supporting body, and is formed in plane shape (FIG. 4). Accordingly, a touch state of the fixation belt 4 and the heat source 6 in embodiment 1, as shown by FIG. 6A, an aperture "t" exists between the fixation belt 4 and the heat source 6, therefore, there are possibilities that a heat conduction is impeded or that the heat source 6 is damaged because a temperature of itself rises too much. The purpose of the embodiment is to prevent the above inconvenience.

As shown by FIG. 6A, in a fixing device 50B of embodiment 2, the drive use assisting roller 7 is furnished in a position opposite to the heat source 6, the drive use assisting roller 7 and the heat source 6 sandwich and hold the fixation belt 4. Accordingly, because the fixation belt 4 is pressed by the heat source 6 by the drive use assisting roller 7, so the aperture does not occur between the fixation belt 4 and the heat source 6.

By adopting the above explained structure, in the embodiment, it becomes possible to secure stability of touch of the heat source 6 and the fixation belt 4, therefore, it becomes possible to attempt stabilization of heat conduction characteristic. Further, by attempting stabilization of heat conduction characteristic, it becomes possible to prevent a breakage of the heat source 6 due to overheat of the heat source 6.

THE UTILIZATION POSSIBILITY IN INDUSTRY

In the embodiment 1 and the embodiment 2, only such case is explained that the fixing device of the present invention is applied to a color electronic printer serving as an image forming apparatus. However, the present invention is not limited by the case. That is, the present invention also can be applied to an image forming apparatus such as copying apparatus, facsimile and the like. In the case, it is possible to use the fixing device of the present invention as a means/an apparatus that forms toner formed from resin having heating fusion characteristic by using an image forming processing means such as a color electronic printer; and performs a heating/pressure fixing process of non-fixation toner corresponding to the desired image information.

The present invention is not limited to the foregoing embodiments but many modifications and variations are possible within the spirit and scope of the appended claims of the invention.

What is claimed is:

1. A fixing device to fix a toner image that is transferred on a record medium though using an endless belt heated by a heating member, comprising:

a first pressing member;

a second pressing member;

a rotating member, and a supporting member, wherein the endless belt is extended by the first pressing member and the heating member;

the second pressing member and the first pressing member sandwich and hold the endless belt to press the endless belt;

the rotating member is externally contacted with the endless belt and drives the endless belt to move;

the heating member is provided in the supporting member at a downstream side of the supporting member in a moving direction of the endless belt; and the rotating member is pressed to the endless belt at an upstream side of the supporting member in the moving direction of the endless belt.

2. The fixing device according to claim 1, wherein the heating member is a surface-shaped heater.

3. The fixing device according to claim 2, wherein the supporting member supports the surface-shaped heater; and the rotating member is furnished opposite to the supporting member, sandwiches and holds the endless belt with the supporting member.

4. The fixing device according to claim 3, wherein the surface-shaped heater is furnished on an upstream side from a contact part of the endless belt and the second pressing member along a movement direction of the endless belt.

5. The fixing device according to claim 3, wherein the rotating member is furnished opposite to the supporting member on an upstream side from a support position to support the surface-shaped heater along a movement direction of the endless belt.

6. An image forming apparatus, comprising:

a fixing device to fix a toner image that is transferred on a record medium though using an endless belt heated by a heating member, wherein the fixing device includes:

a first pressing member;

a second pressing member;

a rotating member, and a supporting member, wherein the endless belt is extended by the first pressing member and the heating member;

the second pressing member and the first pressing member sandwich and hold the endless belt to press the endless belt;

the rotating member is externally contacted with the endless belt and drives the endless belt to move;

the heating member is provided in the supporting member at a downstream side of the supporting member in a moving direction of the endless belt; and the rotating member is pressed to the endless belt at an upstream side of the supporting member in the moving direction of the endless belt.

7. The image forming apparatus according to claim 6, wherein the heating member is a surface-shaped heater.

8. The image forming apparatus according to claim 7, wherein the supporting member supports the surface-shaped heater, and wherein the rotating member is furnished opposite to the supporting member, sandwiches and holds the endless belt with the supporting member.

9. The image forming apparatus according to claim 8, wherein the surface-shaped heater is furnished on an upstream side from a contact part of the endless belt and the second pressing member along a movement direction of the endless belt.

10. The image forming apparatus according to claim 7, wherein the rotating member is furnished opposite to the supporting member on an upstream side from a support position to support the surface-shaped heater along a movement direction of the endless belt.

* * * * *